United States Patent [19]

Longobardi

[11] 4,187,819

[45] Feb. 12, 1980

[54] FRUSTO-CONICAL, SPIRAL FUEL ECONOMIZATION AND POLLUTION REDUCTION DEVICE FOR USE WITH CARBURETORS OF INTERNAL COMBUSTION ENGINES

[76] Inventor: Roberto Longobardi, Viale Europa 2/E, Castellammare di Stabia, Prov. Naples, Italy

[21] Appl. No.: 872,627

[22] Filed: Jan. 26, 1978

[30] Foreign Application Priority Data

Apr. 5, 1977 [IT] Italy ..... 48838 A/77
Sep. 27, 1977 [FR] France ..... 77 28983

[51] Int. Cl.[2] ..... F02M 29/00
[52] U.S. Cl. ..... 123/141; 261/79 R; 48/180 B
[58] Field of Search ..... 123/141, 122 F; 261/78 R, 79 R; 48/180 B, 180 M, 180 S

[56] References Cited

U.S. PATENT DOCUMENTS

| | | | |
|---|---|---|---|
| 1,320,528 | 11/1919 | Borkes | 123/122 F |
| 1,412,891 | 4/1922 | Pomeroy | 123/122 F |
| 1,456,018 | 5/1923 | Wiegand | 123/122 F |
| 1,780,130 | 10/1930 | Heard | 48/180 B |
| 2,139,777 | 12/1938 | Skok et al. | 123/122 F |

FOREIGN PATENT DOCUMENTS

| | | | |
|---|---|---|---|
| 2539609 | 3/1977 | Fed. Rep. of Germany | 123/141 |
| 2305601 | 3/1975 | France | 123/141 |
| 327457 | 4/1930 | United Kingdom | 123/141 |
| 350122 | 6/1931 | United Kingdom | 123/141 |

*Primary Examiner*—Ira S. Lazarus
*Attorney, Agent, or Firm*—James J. Romano, Jr.

[57] ABSTRACT

New and improved fuel economization and pollution reductions means for use with carbureted, internal combustion engines are disclosed, and comprise frusto-conical, spiral mixing means which are disposed in the fuel-air mixture passage of the engine to result in more complete fuel combustion, with resultant increase in fuel efficiency and reduction in exhaust gas pollutants.

5 Claims, 7 Drawing Figures

FRUSTO-CONICAL, SPIRAL FUEL ECONOMIZATION AND POLLUTION REDUCTION DEVICE FOR USE WITH CARBURETORS OF INTERNAL COMBUSTION ENGINES

BACKGROUND OF THE INVENTION

1. Field of the Invention.

This invention relates to a new and improved frusto-conical, spiral fuel economization and pollution reduction device for use with the carburetors of internal combustion engines.

2. Description of the Prior Art.

Although fuel economization and/or pollution reduction devices for use in or with the carburetors of internal combustion engines are known, the same are, in many instances, relatively complex and expensive, and require the use of one or more moving parts to thus reduce the overall reliability thereof. Too, many of the prior art devices of this nature require relatively extensive modification of the internal engine carburetor for the utilization thereof and, in addition, require relatively precise calibration and regular servicing. Also, many of these prior art devices are not readily adaptable for use with a wide variety of different internal combustion engine carburetors. Further, it is believed very well known by those skilled in this art that, in many instances, the actual performance provided by the prior art fuel economization and/or pollution reduction devices falls far short indeed of the performance claims made for such devices.

OBJECTS OF THE INVENTION

It is, accordingly, an object of this invention to provide a new and improved, frusto-conical, spiral device for use with the carburetors of internal combustion engines which functions to significantly increase the fuel efficiency of such engines.

Another object of this invention is the provision of a new and improved, frusto-conical, spiral device as above which accordingly functions to significantly increase the power output for a given amount of fuel, and thus significantly decrease the fuel comsumption, of the internal combustion engine with which the same is used.

Another object of my invention is the provision of a new and improved, frusto-conical spiral device as above which functions to significantly reduce the pollutants in the exhaust gases of the internal combustion engines with which the same is used.

A further object of this invention is the provision of a new and improved, frusto-conical spiral device as above which may be readily and conveniently utilized with most internal combustion engine carburetors without the requirement for structural modification of the latter.

A still further object of this invention is the provision of a new and improved, frusto-conical spiral device as above of relatively simple design and construction having no moving parts, and which requires the use of only few parts of readily available, relatively low cost materials of proven durability in the fabrication thereof to thus insure relatively low fabrication costs and long periods of satisfactory, maintenance-free operation of the device.

SUMMARY OF THE DISCLOSURE

As disclosed herein, the new and improved frusto-conical, spiral fuel economization and pollution reduction device of my invention comprises a frusto-conical, spiral mixing element which is mounted, by means of a suitably apertured mounting plate, intermediate the carburetor and intake manifold of an internal combustion engine. In operation, the flow of the fuel-air mixture from the carburetor through the mixing element imparts a powerful vortex-like motion to the mixture with resultant further admixture thereof. In addition, this motion reduces contact of the fuel-air mixture with the heated, intake manifold walls. As a result, more complete combustion of the fuel-air mixture is achieved with attendant reduction in engine fuel consumption and exhaust gas pollutants, and increase in engine power per given amount of fuel.

DESCRIPTION OF THE DRAWINGS

The above and objects and significant advantages of my invention are believed made clear by the following detailed description thereof taken in conjunction with the accompanying drawings wherein.

DETAILED DESCRIPTION OF THE INVENTION

Figure 1:
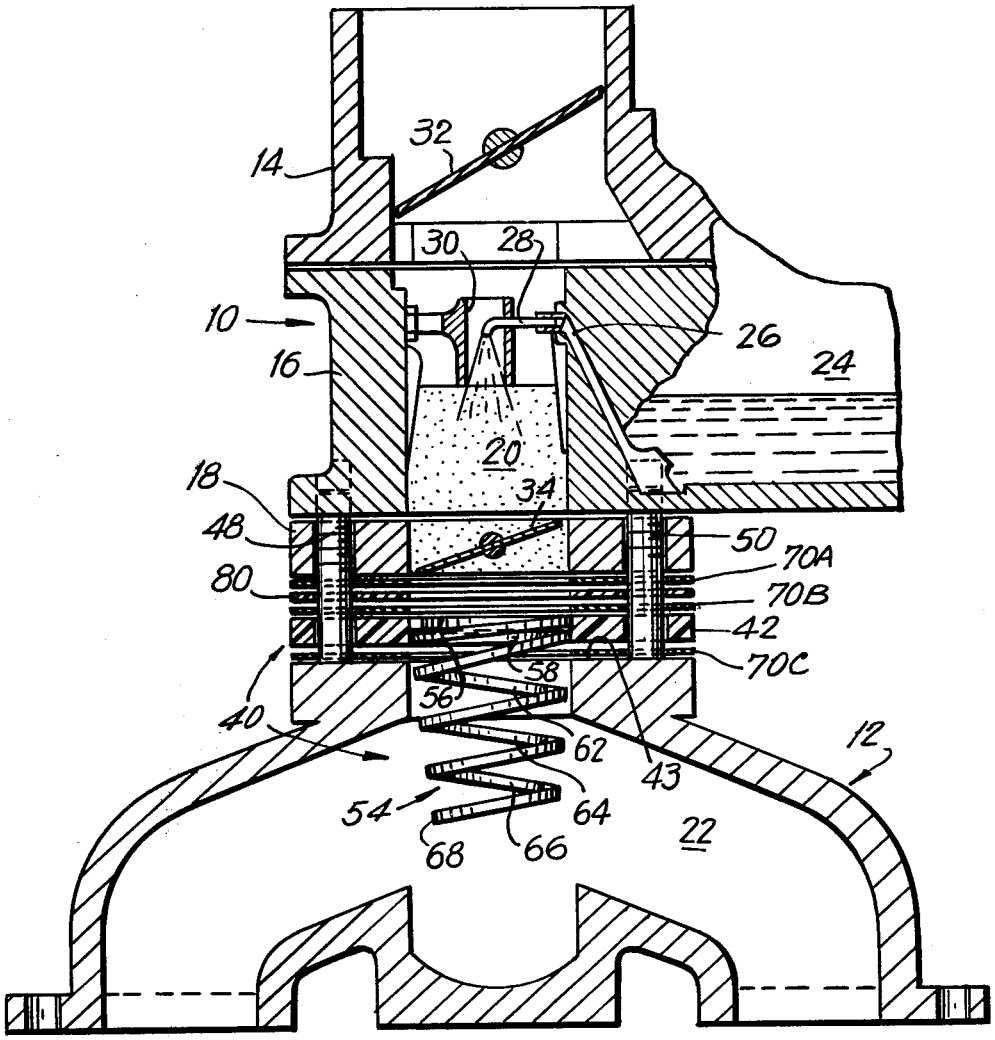
FIG. 1 is a vertical cross-sectional view taken through a representative carburetor of an internal combustion engine, with parts in phantom and parts in elevation, and illustrates the operative disposition of the partially disassembled frusto-conical, spiral economization and pollution reduction device of my invention therein.

Referring now to FIG. 1 of the drawings, a representative carburetor for an internal combustion engine is indicated generally at 10 and is depicted in operative relationship with the intake manifold of an internal combustion engine as indicated generally at 12.

Although not, per se, forming part of my invention, the carburetor 10 will be readily understood by those skilled in this art to comprise main body parts 14, 16 and 18 which cooperate as shown to form a fuel-air mixture intake passage 20 for delivery of the fuel-air mixture to the intake passage 22 of the manifold 12.

A carburetor fuel bowl is indicated at 24, and is connected by a fuel passage 26 to supply fuel through jet 28 to venturi nozzle 30 for mixture with the incoming air in manner well known to those skilled in this art. A choke or butterfly valve is indicated at 32 and is, of course, operable to reduce the amount of air admitted to carburetor passage 20; while a throttle or butterfly valve is indicated at 34 and is, of course, operable to control the amount of the fuel-air mixture admitted through carburetor, fuel-air mixture passage 20 to intake passage 22 of the intake manifold 12.

Figure 2:
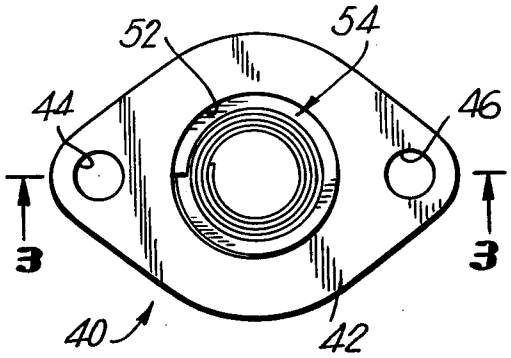
FIG. 2 is a top elevational view of the mounting body and mixing element of the device of my invention.
Figure 3:
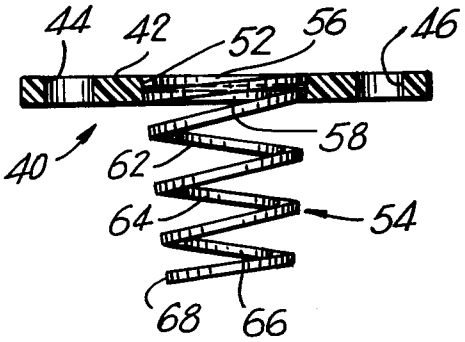
FIG. 3 is a cross-sectional view taken along line 3—3 in FIG. 2.

A frusto-conical, spiral fuel economization and pollution reduction device constructed and operative in accordance with the teachings of my invention is indicated generally at 40 in FIGS. 1, 2 and 3, and comprises an adapting or mounting body 42 which is, of course, configured in the manner of the carburetor body parts 16 and 18, and the carburetor mounting surface 43 of the intake manifold 12 to insure ready structural compatibility therebetween as discussed in greater detail hereinbelow. Although a wide variety of materials may be utilized in the fabrication of mounting body 42, it is preferred that the same be fabricated from a material of good heat insulative properties, and it may here be noted that a strong synthetic resin material in the nature of Bakelite has proven particularly satisfactory in this regard.

Mounting apertures as indicated at 44 and 46 are formed as shown adjacent opposite edge portions of the mounting body 42 and are, of course, sized in accordance with the size of the respective, spaced carburetor mounting studs 48 and 50 (FIG. 1) which extend as shown upwardly from the carburetor mounting surface 43 of the intake manifold 12.

A circular aperture 52 is formed as shown generally centrally of the mounting body 42 and is, of course, sized and located in the said mounting body in such manner as to be dimensionally compatible and in alignment with the fuel-air mixture passage 20 in the carburetor 10, and with the upper terminus of the fuel-air mixture passage 22 in the intake manifold 12. A slight conicality, or reduction in diameter in the downward direction, is provided for the aperture 52 for purposes described in greater detail hereinbelow.

A mixing element is indicated generally at 54 and is fabricated from a strip of an appropriate material, such as metal, which is preferably of generally rectangular cross section. The mixing element takes the form of the depicted frusto-conical spiral, and comprises initial or mounting coils 56 and 58 which are sized and configured to fit closely as shown into the slightly conical aperture 52 in mounting body 42 to prevent the mixing element 54 from failing downwardly through said aperture as should be obvious.

As depicted, the mixing element 54 comprises a number of additional coils 62, 64, and 66 of decreasing diameter which extend downwardly from the mounting body 42 to terminate as indicated at 68 radially outwardly of the axis of the mixing element 54, thus result in the overall, frusto-conical, spiral configuration of the said mixing element. Although, for purposes of illustration, the mixing element 54 is depicted as comprising somewhat over five coils, it will be readily understood by those skilled in this art that this number of coils may vary in accordance with the particular operational characteristics of the carburetor in which the mixing element 54 is utilized. Too, and although the extent of the frusto-conicality of the mixing element 54 may also vary as above, a representative ratio between the diameter of the element at the top or initial coil, and the diameter of the element at the bottom or last coil might, for example, be approximately 32/25.

Figure 4:
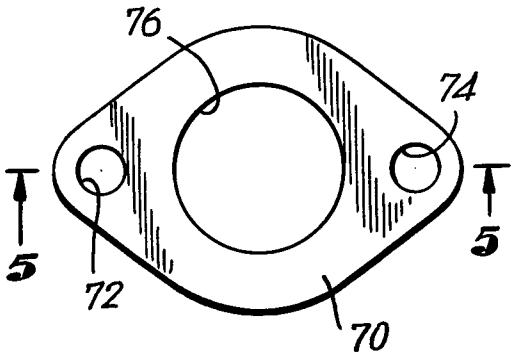
FIG. 4 is a top plan view of one of the sealing gaskets of the device of my invention.
Figure 5:
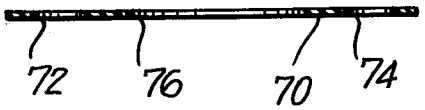
FIG. 5 is a cross-sectional view taken along line 5—5 in FIG. 4.

A sealing gasket of any appropriate gasket material is indicated at 70 in FIGS. 4 and 5, and will readily be seen to comprise mounting apertures 72 and 74, and a generally central aperture 76 for the passage of the fuel-air mixture therethrough, all in the manner of the mounting body 42 of FIG. 2.

Figure 6:
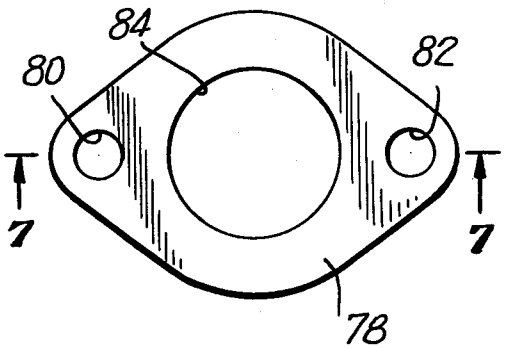
FIG. 6 is a top plan view of an intermediate or spacer member of the device of my invention.
Figure 7:
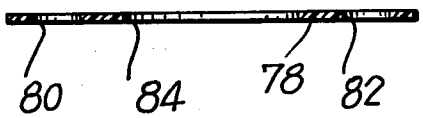
FIG. 7 is a cross-sectional view taken along line 6—6 in FIG. 6.

An intermediate or spacer element, which is preferably of the same material as mounting body 42, is indicated at 78 in FIGS. 6 and 7 and, in the manner of that mounting body and sealing gasket 70, will be seen to comprise mounting apertures 80 and 82, and a generally central aperture 84 for the passage of the fuel-air mixture therethrough.

Although the exact number of sealing gaskets and/or intermediate or space members may vary from application to application of the device of my invention depending on the configuration and performance characteristics of the carburetor with which the same is used, it will be noted that, in the representative carburetor application of FIG. 1, three sealing gaskets as indicated at 70A, 70B and 70C, and one intermediate or spacer member 78 are used. In this application, it is preferred that the diameter of aperture 76 in sealing gasket 70B be just slightly smaller, as for example one millimeter, that the aperture 52 in mounting body 42 to thus insure that the said sealing gasket will partially overlie the initial coil 56 of the mixing element 54 and firmly retain the latter in position within the aperture 42.

Assembly and operative disposition of the frusto-conical, spiral fuel economization and pollution reduction device 40 of my invention for the representative application thereof of FIG. 1 intermediate the carburetor 10 and intake manifold 12 is believed to self-evidently comprise the disposition of the mixing element 54 in aperture 52 on mounting body 42, and the subsequent, aligned disposition of sealing gasket 70C, the mounting body-mixing element combination 42–54, the sealing gasket 70B, the intermediate element 80, the sealing gasket 70A, and the carburetor body parts 18 and 16, respectively, as shown atop the intake manifold. Thereafter, assembly is, of course, completed by the tightening of the carburetor mounting studs 48 and 50 to fixedly secure the carburetor 10 atop the intake manifold 12; with the respective sealing gaskets functioning to insure a hermetic seal between the mounting body 42 and the carburetor body part 18 and intake manifold 12 and thus insure that no leakage of ambient, engine compartment air takes place into or around the device 40 of my invention. In those instances wherein the device 40 of my invention is not furnished as standard equipment with the carburetor, but rather, is added thereto as a fuel economization and pollution reduction option, it will be readily understood by those skilled in this art that one-time-only recalibration of the carburetor jets may be required.

In operation, the fuel economization and pollution reduction device 40 of my invention functions to advantageously, significantly increase the admixture of the fuel-air mixture from the carburetor 10 flowing therethrough by imparting a powerful vortex-like, whirling or mixing motion to the mixture as the same is drawn through the downwardly spiralling configuration of the mixing element 54. In addition, this powerful vortex-like motion imparted as described to the fuel-air mixture attendant the passage thereof through the mixing element 54 functions, of course, to advantageously, significantly increase the velocity at which said mixture leaves said element for flow into and through the intake manifold passage 22 into the combustion chambers of the internal combustion engine. Further, the centripetal forces generated in the fuel-air mixture attendant the vortex-like motion imparted thereto as described by the mixing element 54 will significantly reduce surface contact of the mixture with the hot walls of the intake manifold 12; and this feature, combined with the heat-insulative properties of the mounting body 42, will function to advantageously, significantly reduce the temperature of the fuel-air mixture upon entry into the downstream portions of intake manifold passages 26.

The overall result of all of the above is that more complete combustion of the fuel is provided, with attendant increase in engine power output for a given amount of fuel, and corresponding decrease in engine fuel consumption and in the amount of pollutants found in the engine exhaust gases. Actual tests have, for example, established that a representative application of the device of my invention to the carburetor of an internal combustion engine has resulted in a reduction in fuel consumption of approximately 25%.

Although, as discussed hereinabove, the basic dimensions and configuration of the spiral mixing element 54 may vary from application to application, representative dimensions and configuration therefor are a rectangular cross section of 0,8×2,5 millimeters having a spiral tread of about 8 millimeters.

Although illustrated in conjunction with what may be termed a "single barrel" carburetor, it will be clear to those skilled in this art that the device 40 of my invention would be equally applicable for use with "multi-barrel" carburetors, in which instances there would, of course, be one aperture 52 in mounting body 42 for each such carburetor "barrel," and one mixing element 54 operatively disposed as described in each of said apertures.

The device of my invention is clearly applicable to a wide variety of carbureted, internal combustion engines including, but not limited to, those used to power automobiles, buses, tractors, boats, construction vehicles and the like; and is also clearly applicable to a wide variety of stationary, carbureted internal combustion engine applications.

Various changes may, of course, be made in the disclosed embodiment of my invention without departing from the spirit and scope thereof as defined in the appended claims.

What is claimed is:

1. In a fuel economization and pollution reduction device for use with the carburetor of an internal combustion engine having an intake manifold, the improvements comprising, a frusto-conical spiral mixing element having an unobstructed, generally frusto-conical flow passage extending therethrough, and means to mount said element in the fuel-air mixture passage from the carburetor to the intake manifold with the axis of said element being in general alignment with the axis of said passage whereby, the fuel-air mixture from said carburetor will flow through said element and a vortex-like or whirling motion will be thereby imparted to said fuel-air mixture to further admix the same said frusto-conical spiral mixing element extending into said intake manifold whereby, contact by said fuel-air mixture with the heated walls of said manifold, and attendent heating thereby of said mixture, will be reduced due to the centripetal forces generated within said mixture by said vortex-like motion, said frusto-conical spiral mixing element comprising a plurality of coils of decreasing diameter in the direction of flow of said fuel-air mixture, and wherein said mounting means comprises a mounting body having a generally frusto-conical aperture formed therein, said aperture being complementally sized and shaped with regard to the largest diameter of said coils and being in general alignment with the fuel-air mixture passage from said carburetor for the flow of said fuel-air mixture therethrough, and wherein said frusto-conical mixing element is mounted in said mounting body by the disposition of said largest diameter coil in said aperture.

2. In a fuel economization and pollution reduction device as in claim 1 wherein, said frusto-conical spiral mixing element terminates in a free end.

3. In a fuel economization and pollution reduction device as in claim 1 wherein, said frusto-conical spiral mixing element comprises a plurality of coils of decreasing diameter in the direction of flow of said fuel-air mixture, and wherein the ratio between the diameter of the largest of said coils of the spiral mixing element and the diameter of the smallest of said coils of the spiral mixing element ranges between 1.1 and 1.5.

4. In a fuel economization and pollution reduction device as in claim 3 wherein, said ratio is approximately 1.28.

5. In a fuel economization and pollution reduction device for use with the carburetor of an internal combustion engine having an intake manifold the improvements comprising, a frusto-conical spiral mixing element having an unobstructed, generally frusto-conical flow passage extending therethrough, and means to mount said element in the fuel-air mixture passage from the carburetor to the intake manifold with the axis of said element being in general alignment with the axis of said passage whereby, the fuel-air mixture from said carburetor will flow through said element and a vortex-like or whirling motion will be thereby imparted to said fuel-air mixture to further admix the same, said frusto-conical spiral mixing element comprising a plurality of coils of decreasing diameter in the direction of flow of said fuel-air mixture, and wherein said mounting means comprise a mounting body having a generally frusto-conical aperture formed therein, said aperture being complementally sized and shaped with regard to the largest diameter of said coils and being in general alignment with the fuel-air mixture passage from said carburetor for the flow of said fuel-air mixture therethrough, and wherein said frusto-conical mixing element is mounted in said mounting body by the disposition of said largest diameter coil in said aperture, said mounting body is fabricated from a material of good heat-insulative qualities whereby, heating of said frusto-conical mixing element through said mounting body is inhibited.

* * * * *